US006283091B1

(12) United States Patent
Bartel et al.

(10) Patent No.: US 6,283,091 B1
(45) Date of Patent: Sep. 4, 2001

(54) METHOD AND APPARATUS FOR CONTROLLING NOZZLE TEMPERATURE DURING ENGINE BRAKING

(75) Inventors: John B. Bartel, Hedgesville, WV (US); Joseph H. Schmidt, Hagerstown; Jeffrey S. Zsoldos, Mount Airy, both of MD (US)

(73) Assignee: Mack Trucks, Inc., Allentown, PA (US)

( * ) Notice: Subject to any disclaimer, the term of this patent is extended or adjusted under 35 U.S.C. 154(b) by 0 days.

(21) Appl. No.: 09/482,566

(22) Filed: Jan. 14, 2000

(51) Int. Cl.[7] ..... F02D 13/04; F02M 53/04
(52) U.S. Cl. ..... 123/322; 239/132.5
(58) Field of Search ..... 123/320, 321, 123/322; 239/125, 132, 132.5, 533.3

(56) References Cited

U.S. PATENT DOCUMENTS

| | | | | |
|---|---|---|---|---|
| 2,178,152 | | 10/1939 | Walker | 123/321 |
| 2,264,914 | | 12/1941 | L'Orange | 239/132.5 |
| 2,886,014 | | 5/1959 | Konrad et al. | 239/132 |
| 3,023,870 | | 3/1962 | Udelman | 477/188 |
| 3,220,392 | | 11/1965 | Cummins | 123/321 |
| 3,844,479 | * | 10/1974 | Needham | 239/125 |
| 4,106,702 | * | 8/1978 | Gardner et al. | 239/533.3 |
| 4,369,750 | * | 1/1983 | Muntean et al. | 123/505 |
| 4,471,909 | | 9/1984 | Perr | 239/89 |
| 4,658,781 | | 4/1987 | Guinea | 123/325 |
| 4,741,307 | | 5/1988 | Meneely | 123/321 |
| 4,804,143 | * | 2/1989 | Thomas | 239/533.3 X |
| 4,848,289 | | 7/1989 | Meneely | 123/182 |
| 4,932,372 | | 6/1990 | Meneely | 123/182 |
| 4,945,870 | | 8/1990 | Richeson | 123/90.11 |
| 5,012,778 | | 5/1991 | Pitzi | 123/321 |
| 5,117,790 | | 6/1992 | Clarke et al. | 123/321 |
| 5,409,165 | * | 4/1995 | Carroll, III et al. | 239/533.3 X |
| 5,603,300 | | 2/1997 | Feucht et al. | 123/322 |
| 5,634,447 | | 6/1997 | Rowells | 123/322 |
| 5,813,231 | | 9/1998 | Faletti et al. | 60/602 |

* cited by examiner

*Primary Examiner*—Tony M. Argenbright
(74) *Attorney, Agent, or Firm*—Rothwell, Figg, Ernst & Manbeck

(57) ABSTRACT

An engine exhaust braking method and apparatus. The method includes injecting a predetermined amount of fuel per stroke into an engine cylinder during engine braking, wherein the predetermined amount of fuel cools the fuel injector nozzle, thereby allowing the engine braking to be performed without damage to the fuel injector nozzle due to excessive heat. The apparatus includes a fuel injector having a nozzle and capable of injecting a predetermined amount of fuel into an engine, and a processor connected to the fuel injector, with the processor monitoring engine operation and capable of causing the fuel injector to inject the predetermined amount of fuel into the engine, wherein a predetermined amount of fuel is injected into the engine to cool the fuel injector nozzle, thereby allowing the exhaust braking to be performed without damaging the fuel injector nozzle due to excessive heat.

33 Claims, 4 Drawing Sheets

METHOD AND APPARATUS FOR CONTROLLING NOZZLE TEMPERATURE DURING ENGINE BRAKING

BACKGROUND OF THE INVENTION

1. Field of the Invention

The present invention relates to the field of engine braking.

2. Description of the Background Art

Engine braking is an engine operating mode wherein the engine is reconfigured during operation to provide a braking effect to a vehicle. This may be desirable or necessary when regular wheel brakes are inadequate to provide complete braking. An example is a need for powerful and prolonged braking operations on steep grades, such as on mountain roads. Engine braking finds particular applicability on large vehicles having high wheel weights and correspondingly high momentum, and where conventional wheel brakes may fade or fail under high loading conditions or under prolonged use.

Rowells, U.S. Pat. No. 5,634,447 discloses a related art approach wherein fuel is injected during engine braking for increased braking power. Rowells, however, only addresses mass flow braking systems. Rowells injects a small quantity of fuel into the cylinders of the engine well in advance of top dead center on the compression stroke, raising cylinder pressure during compression and increasing energy to the turbocharger, inherently increasing boost pressure and braking power. Rowells therefore injects fuel to increase the turbocharger speed, which then provides more mass flow for increased braking power. Rowells does not apply to engine braking using an exhaust throttle concept, where there is very little mass flow.

One type of engine braking works by closing an exhaust throttle device in the exhaust system of the engine, thereby restricting the outflow of exhausted gases and therefore slowing the engine. This is a simple and effective way of providing additional braking power to vehicles without adding expensive and complicated devices to the valvetrain or internal structure of an engine.

A drawback of such a braking system is that internal cylinder temperatures may become very high. Excessive cylinder temperatures may be harmful to engine components. One such component is the nozzle of a fuel injector. Excessive temperatures may damage the nozzle, with a resulting degradation in engine performance.

Therefore, there remains a need in the art for improvements in engine braking systems.

SUMMARY OF THE INVENTION

A method for controlling a fuel injector nozzle temperature during engine braking is provided according to a first aspect of the invention. The method comprises injecting a predetermined amount of fuel per stroke into an engine cylinder during engine braking, wherein the predetermined amount of fuel cools the fuel injector nozzle, thereby allowing the engine braking to be performed without damage to the fuel injector nozzle due to excessive heat.

A method for controlling a fuel injector nozzle temperature during engine braking is provided according to a second aspect of the invention. The method comprises the steps of determining whether an exhaust throttle is engaged, determining whether an engine speed exceeds a predetermined engine speed threshold, and injecting a predetermined amount of fuel per stroke using a fuel injector if the exhaust throttle is engaged and if the engine speed exceeds the predetermined engine speed threshold, wherein the predetermined amount of fuel cools the fuel injector nozzle, thereby allowing the exhaust braking to be performed without damage to the fuel injector nozzle due to excessive heat.

An apparatus for controlling a fuel injector nozzle temperature during engine braking is provided according to a third aspect of the invention. The apparatus comprises a fuel injector having a nozzle and capable of injecting a predetermined amount of fuel into an engine, and a processor connected to the fuel injector, with the processor monitoring engine operation and capable of causing the fuel injector to inject the predetermined amount of fuel into the engine, wherein the predetermined amount of fuel is injected into the engine to cool the fuel injector nozzle, thereby allowing the exhaust braking to be performed without damaging the fuel injector nozzle due to excessive heat.

The above and other features and advantages of the present invention will be further understood from the following description of the preferred embodiment thereof, taken in conjunction with the accompanying drawings.

DETAILED DESCRIPTION OF THE PREFERRED EMBODIMENTS

Figure 1:
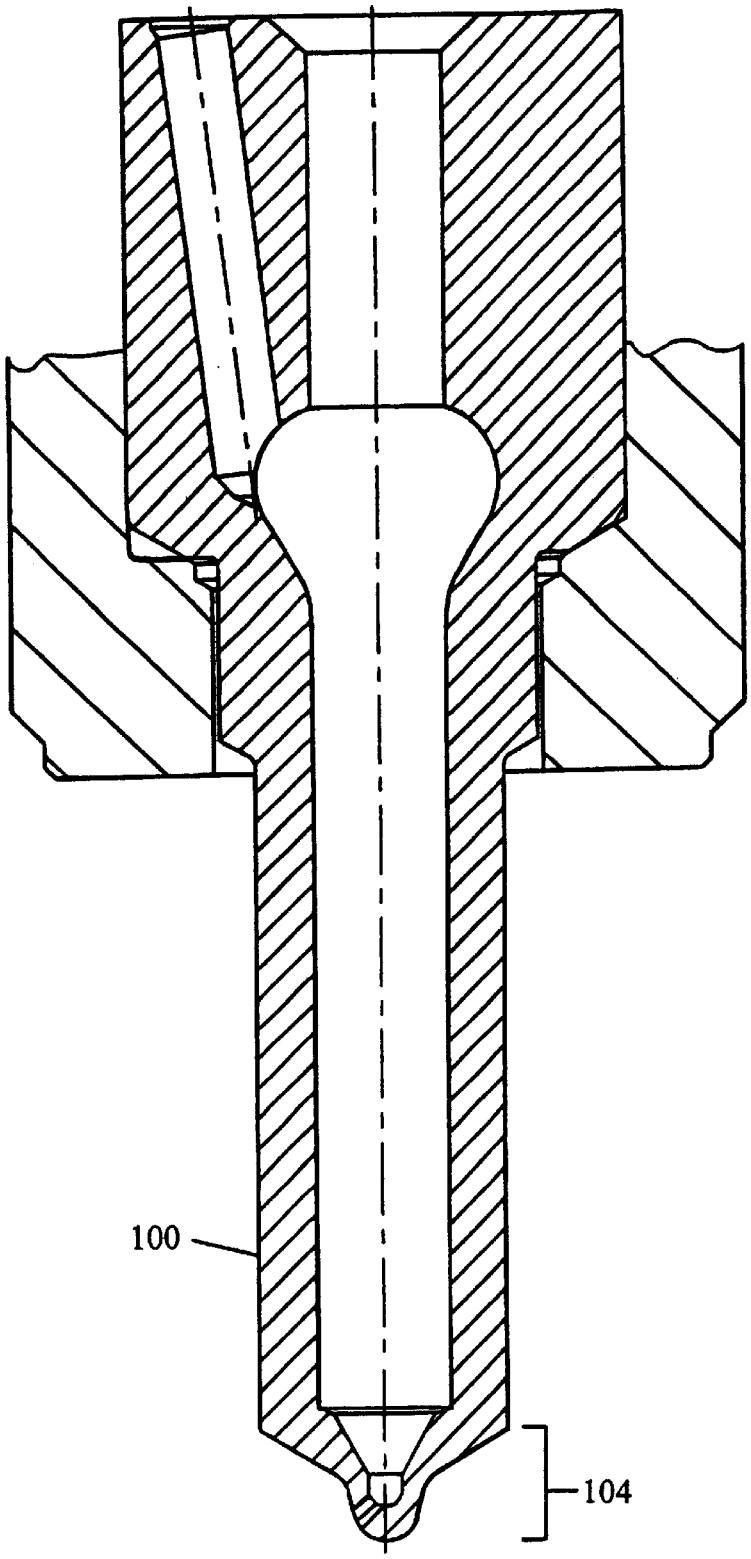
FIG. 1 shows one embodiment of a typical fuel injector used in an internal combustion engine.

FIG. 1 shows one embodiment of a typical fuel injector 100 used in an internal combustion engine. The fuel injector 100 includes a nozzle 104, which is used to inject fuel into a cylinder of the engine. Generally, only the nozzle 104 extends into the combustion chamber formed by a cylinder and a cavity in the engine head. Therefore, the nozzle 104 is subjected to high temperatures, while most of the fuel injector 100 is not.

Figure 2:
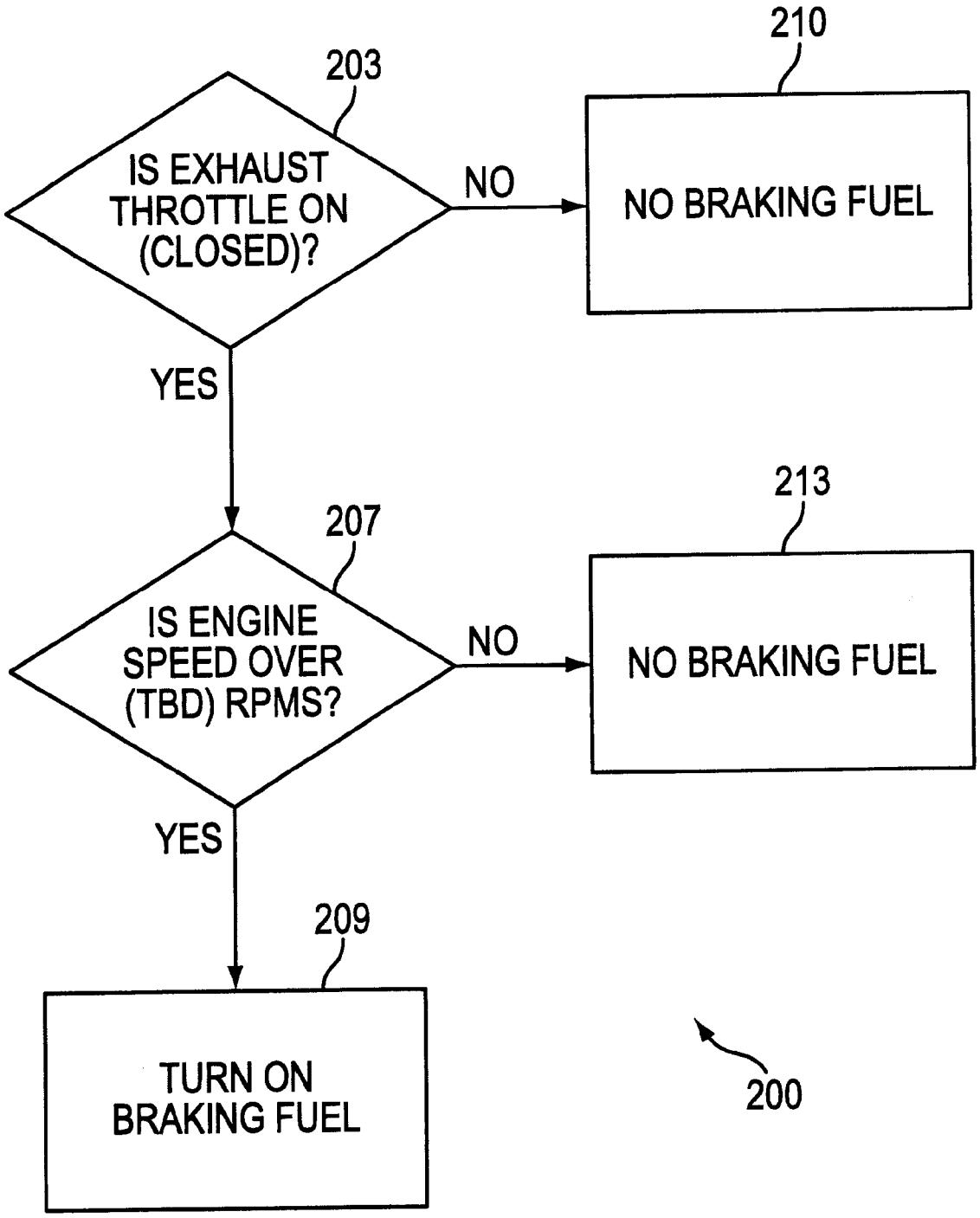
FIG. 2 shows a flowchart of one embodiment of the method of the present invention.

FIG. 2 shows a flowchart 200 of one embodiment of the method of the present invention. In step 203, the method determines whether the exhaust throttle is engaged (ON). If the exhaust throttle is ON, the method proceeds to step 207, else it branches to step 210, where no braking fuel is injected.

In step 207, the method determines whether the engine speed exceeds a predetermined speed threshold. The exhaust braking may be activated below this predetermined speed threshold, but nozzle cooling is not required below the speed threshold. In the preferred embodiment, the predetermined speed threshold is about 1700 revolutions per minute (RPM). However, any suitable speed threshold for a particular engine is acceptable. Typical engines will require a threshold within the range of 1500–2500 RPM. If the predetermined speed threshold is exceeded, the method proceeds to step 209, else it branches to step 213, where no braking fuel is injected.

In step 209, a predetermined amount of braking fuel is injected to cool the nozzle 104 of the injector 100. In the preferred embodiment, five milligrams of fuel is injected per compression stroke of a cylinder. Alternatively, 1 to 30 milligrams of fuel per stroke may be injected, depending on fuel economy concerns versus braking effectiveness and nozzle temperatures.

Theoretically, the cooling fuel may be injected for nozzle cooling at any time in the engine cycle (during braking), or the fuel may be injected at a fixed point in the engine cycle. In the preferred embodiment, the fuel is injected at about thirty degrees of crankshaft rotation before top dead center (TDC) of a compression stroke. In addition to controlling the injection timing during the engine cycle, the method may inject fuel at every such cycle, or may inject fuel occasionally, such as every second or third cycle, etc.

In another advantageous feature of the present invention, fuel may be injected into a cylinder when the associated piston is traveling toward top dead center, so that the fuel can be burned before the piston is at TDC, and thus provides additional braking power. This does not speed up the turbocharger, but rather functions to increase the pressure against the piston as it approaches TDC.

In alternate embodiments, once it has been determined that the exhaust throttle is engaged, the fuel injection process may include an engine speed determination plus a check for an exhaust manifold temperature exceeding a predetermined temperature. A preferred temperature threshold range is about 950–1,200° F., is most preferably about 1,100° F. Alternatively, the method may include only an exhaust throttle position determination plus an exhaust manifold temperature threshold check (no check of engine speed).

Figure 3:
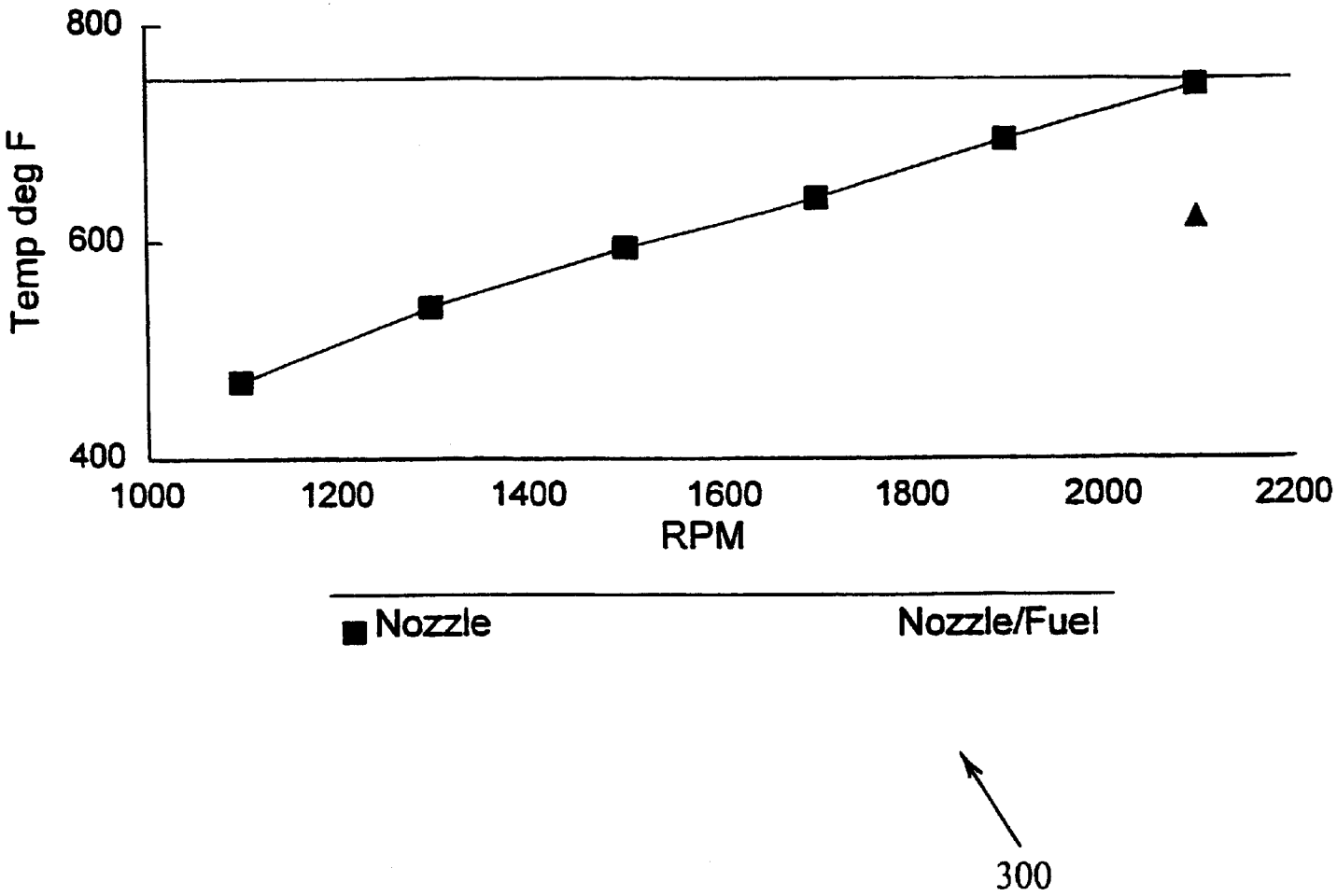
FIG. 3 shows a graph of experimental data that reflects the nozzle cooling effectiveness of the present invention.

FIG. 3 shows a graph 300 of experimental data that reflects the nozzle cooling effectiveness of the present invention. As can be seen from the graph 300, injection of fuel during baking at an engine speed of about 2100 RPM resulted in a nozzle temperature decrease of over 100 degrees Fahrenheit, from about 751 degrees to about 623 degrees (the temperature after fuel injection is represented by the triangular symbol). This temperature decrease allows engine braking to continue beyond what would be a critical limit—the excessive temperatures that may cause damage to fuel injector nozzles.

Figure 4:
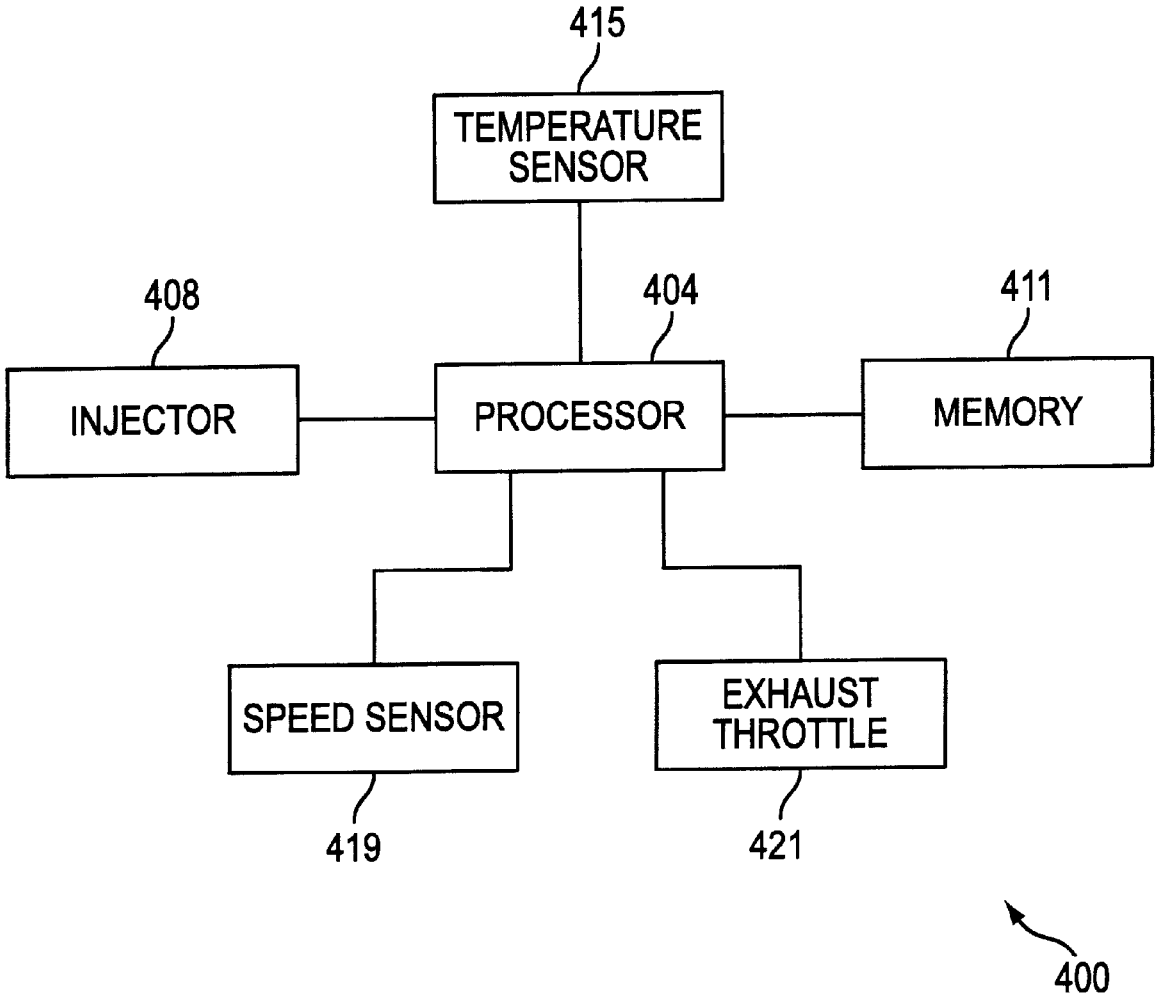
FIG. 4 shows a braking fuel injection apparatus of the present invention.

FIG. 4 shows a braking fuel injection apparatus 400 of the present invention. The apparatus 400 includes a processor 404, an injector 408, a memory 411, a temperature sensor 415, an engine speed sensor 419, and an exhaust throttle position sensor 421. The processor 404 is connected to all of the other devices.

The processor 404 may be any type of general purpose processor. The computer software used to implement the method of the present invention may be stored in the memory 411 and may be executed by the processor 404, which controls all inputs and outputs.

The injector 408 may be any type of general purpose fuel injector used in an internal combustion engine.

The memory 411 may be any type of storage device, such as random-access memory (RAM), read-only memory (ROM), optical storage, or magnetic tape disc, etc. The memory 411 may store control parameters such as: 1) amount of braking fuel to be injected per stroke, 2) injection timing, and 3) the cycles during which the fuel is to be injected (the present invention may inject braking fuel on every engine cycle or may inject braking fuel on alternate or occasional cycles, as needed). Other stored data may include a predetermined speed threshold and a predetermined temperature threshold.

The temperature sensor 415 may be any type of temperature sensor that provides a temperature signal, with the temperature signal being an electronic measurement of the nozzle temperature, the exhaust manifold temperature, the injector temperature, or the cylinder head temperature, etc.

The speed sensor 419 provides an engine speed signal to the processor 404, with the engine speed signal being an electronic measurement of the engine speed in RPM.

The exhaust throttle position sensor 421 provides an exhaust throttle position signal (i.e., ON-OFF) to the processor 404, indicating when the exhaust throttle is engaged. The exhaust throttle position sensor 421 therefore may indicate when engine braking is active.

In operation, the processor 404 receives inputs from the temperature sensor 415, the engine speed sensor 419, and the exhaust throttle position sensor 421. A fuel injector cooling routine may be triggered by an exhaust throttle position ON signal from the exhaust throttle position sensor 421, and may be further triggered by the engine exceeding a predetermined engine speed threshold and/or the temperature exceeding a predetermined temperature threshold, as detected by the engine speed sensor 421 and the temperature sensor 415. Upon the receipt of proper activation signals, the processor 404 may read control parameters out of the memory 411 and from these control parameters generate control signals to operate the fuel injector 408 and inject a predetermined amount of cooling fuel during the braking process.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A method for controlling a fuel injector nozzle temperature during engine braking comprising:

injecting a predetermined amount of fuel per stroke into an engine cylinder during engine braking;

wherein said injecting is performed when an exhaust throttle is engaged, and wherein said predetermined amount of fuel cools said fuel injector nozzle, thereby allowing said engine braking to be performed without damage to said fuel injector nozzle due to excessive heat.

2. The method of claim 1, wherein said injecting is performed on every engine cycle.

3. The method of claim 1, wherein said injecting is performed at predetermined engine cycles.

4. The method of claim 1, wherein said injecting is performed when an engine speed during engine braking exceeds a predetermined engine speed threshold of about 1,500–2,500 rpm.

5. The method of claim 4 wherein said predetermined engine speed threshold is about 1,700 rpm.

6. The method of claim 1, wherein said injecting is performed when an exhaust manifold exceeds a predetermined temperature threshold.

7. The method of claim 6, wherein said injecting is performed when an exhaust manifold temperature exceeds about 1,100 degrees Fahrenheit.

8. The method of claim 6, wherein said injecting is performed when an exhaust manifold exceeds about 950 to about 1,200 degrees Fahrenheit.

9. The method of claim 1, wherein said predetermined amount of fuel is injected into a cylinder at any time in an engine cycle.

10. The method of claim 1, wherein said predetermined amount of fuel is injected during a compression stroke of said engine.

11. The method of claim 1, wherein said predetermined amount of fuel is burned during a compression stroke of a piston of said engine to provide additional braking power.

12. The method of claim 1, wherein said predetermined amount of fuel is injected into a cylinder at a predetermined number of degrees of crankshaft revolution before a top dead center position of a corresponding piston.

13. The method of claim 1, wherein said predetermined amount of fuel is injected into a cylinder at about thirty degrees of crankshaft revolution before a top dead center position of a corresponding piston.

14. The method of claim 1, wherein said predetermined amount of fuel is about five milligrams.

15. The method of claim 1, wherein said predetermined amount of fuel ranges from about 1 to about 30 milligrams per stroke.

16. A method for controlling a fuel injector nozzle temperature during engine braking, comprising the steps of:

determining whether an engine brake is engaged;

determining whether an engine speed exceeds a predetermined engine speed threshold; and injecting a predetermined amount of fuel per stroke using a fuel injector if an exhaust throttle is engaged and if said engine speed exceeds said predetermined engine speed threshold;

wherein said predetermined amount of fuel cools said fuel injector nozzle, thereby allowing said exhaust braking to be performed without damage to said fuel injector nozzle due to excessive heat.

17. The method of claim 16, wherein said injecting is performed on every engine cycle.

18. The method of claim 16, wherein said injecting is performed at predetermined engine cycles.

19. The method of claim 16, wherein said predetermined engine speed threshold is at least about 1,700 rpm.

20. The method of claim 16, wherein said injecting is performed when an exhaust manifold temperature exceeds a predetermined temperature threshold.

21. The method of claim 16, wherein said injecting is performed when an exhaust manifold temperature exceeds 1,100 degrees Fahrenheit.

22. The method of claim 16, wherein said injecting is performed when an exhaust manifold temperature exceeds about 950 to about 1,200 degrees Fahrenheit.

23. The method of claim 16, wherein said predetermined amount of fuel is injected into a cylinder at any time in an engine cycle.

24. The method of claim 16, wherein said predetermined amount of fuel is injected during a compression stroke of said engine.

25. The method of claim 16, wherein said predetermined amount of fuel is burned during a compression stroke of a piston of said engine to provide additional braking power.

26. The method of claim 16, wherein said predetermined amount of fuel is injected into a cylinder at a predetermined number of degrees of crankshaft revolution before a top dead center position of a corresponding piston.

27. The method of claim 16, wherein said predetermined amount of fuel is injected into a cylinder at about thirty degrees of crankshaft revolution before a top dead center position of a corresponding piston.

28. The method of claim 16, wherein said predetermined amount of fuel is about five milligrams.

29. The method of claim 16, wherein said predetermined amount of fuel ranges from about 1 to about 30 milligrams of fuel per stroke.

30. An apparatus for controlling a fuel injector nozzle temperature during engine braking, comprising:

a fuel injector having a nozzle and capable of injecting a predetermined amount of fuel into an engine;

a processor connected to said fuel injector, with said processor monitoring engine operation and capable of causing said fuel injector to inject said predetermined amount of fuel into said engine; and an exhaust throttle position sensor communicating with said processor and providing an exhaust throttle position signal indicating when the exhaust throttle is engaged, wherein said predetermined amount of fuel is injected into said engine to cool said fuel injector nozzle, thereby allowing said exhaust braking to be performed without damaging said fuel injector nozzle due to excessive heat.

31. The apparatus of claim 30, wherein said apparatus further includes a temperature sensor communicating with said processor and providing a temperature signal.

32. The apparatus of claim 30, wherein said apparatus further includes an engine speed sensor communicating with said processor and providing an engine speed signal.

33. The apparatus of claim 30, wherein said apparatus further includes a memory communicating with said processor, said memory storing engine control parameters and storing a fuel amount value for fuel injection during engine braking.

* * * * *